United States Patent [19]

Kahler

[11] 4,014,353

[45] Mar. 29, 1977

[54] FLUID-COOLED SMOKING DEVICE

[76] Inventor: Richard W. Kahler, Rte. 1, Box 61, Rock Cave, W. Va. 26234

[22] Filed: May 14, 1976

[21] Appl. No.: 686,418

[52] U.S. Cl. ..... 131/173; 131/194; 131/231

[51] Int. Cl.[2] ..... A24F 1/30

[58] Field of Search ..... 131/173, 221, 194, 195, 131/231

[56] References Cited

UNITED STATES PATENTS

| | | | |
|---|---|---|---|
| 2,190,312 | 2/1940 | Cullen | 131/173 |
| 2,307,573 | 1/1943 | Cullen | 131/173 |
| 2,815,030 | 12/1957 | Wenger | 131/173 |
| 3,394,710 | 7/1967 | Chang Ping-Chuan | 131/173 |
| 3,872,872 | 3/1975 | Kahler | 131/173 |
| 3,881,499 | 5/1975 | McFadden et al. | 131/173 |

*Primary Examiner*—Stephen C. Pellegrino
*Attorney, Agent, or Firm*—Stanley D. Schwartz

[57] ABSTRACT

A fluid-cooled smoking device includes a housing for containing a liquid coolant, and a tubular member projecting into the housing for supporting a smoking bowl-ash receptacle assembly disposed upon and with the tubular member. Concentric tubular members within the ash receptacle portion of the assembly define a serpentine flow path whereby the smoke and fumes to be inhaled are initially air-cooled, and subsequently, the air-cooled smoke and fumes pass into the liquid coolant so as to be liquid-cooled prior to reaching the smoker. The ash receptacle accumulates burnt tobaccos and ash deposits and prevents the same from entering the liquid coolant whereby the latter remains clean for extended periods of time.

30 Claims, 9 Drawing Figures

FLUID-COOLED SMOKING DEVICE

BACKGROUND OF THE INVENTION

1. Field of the Invention

The present invention relates generally to smoking devices, and more particularly to an improved fluid-cooled smoking device which is portable, readily adaptable for cleaning purposes and the removal of ash deposits therefrom, and is particularly useful in connection with the smoking of rare and expensive smoking tobaccos, improved filterability of the same also being provided.

2. Description of the Prior Art

While smoking devices, particularly those useful for the smoking of rare and expensive tobaccos, are of course known, a particular endeavor of current or recent prior art smoking devices has been to temper the smoke or fumes inhaled by the smoker in view of the fact that such smoke or fumes of the aforenoted tobaccos can normally be harsh, hot and quite irritating to the lungs of the smoker. Water pipes have become exceedingly popular as one means utilized for tempering the smoke generated in connection with the smoking of such tobaccos, such pipes normally including a water or liquid chamber interposed between the bowl, within which the tobaccos to be smoked are deposited, and the mouthpiece utilized by the smoker for inhaling the smoke or fumes. In this manner, as the smoke passes through the water liquid chamber, the same is cleaned of ash and other contaminants, as well as cooled, whereby the adverse effects of the smoke are considerably mitigated and the smoking experience tends to be quite enjoyable as desired.

A primary disadvantage of such prior art water pipes, however, is the fact that as the water of liquid chamber is the primary structure utilized for cleansing the smoke and fumes of ash and other contaminants, the water or other liquid becomes contaminated with ashes within a relatively short period of time, and consequently must be changed frequently. In addition, it has been found that although such prior art devices employ a water chamber for the purpose of cooling the smoke and fumes, the volume of such chamber, as well as the flow path defined therein through which the smoke and fumes must travel, is too small for efficiently cooling the smoke and fumes to an acceptable level, and consequently, despite such alleged water cooling structure, the smoke and fumes inhaled remain insufficiently cooled.

OBJECTS OF THE INVENTION

Accordingly, it is a significant object of the present invention to provide a new and improved fluid-cooled smoking device.

Another principal object of the present invention is to provide a new and improved fluid-cooled smoking device which effectively overcomes the disadvantages characteristic of the prior art devices.

Still another object of the present invention is to provide a new and improved fluid-cooled smoking device which will effectively cool the smoke and fumes to be inhaled to acceptable and desirable levels.

A still further object of the present invention is to provide a new and improved fluid-cooled smoking device which will effectively prevent the liquid cooling chamber from becoming contaminated and therefore obviate the necessity of frequently changing the coolant fluid therein.

Still another object of the present invention is to provide a new and improved fluid-cooled smoking device wherein an ash and residue chamber is provided separately and independently of the liquid coolant chamber.

A further object of the present invention is to provide a new and improved fluid-cooled smoking device wherein the residue chamber is readily accessible for cleaning the same whereby easy cleaning of the device is facilitated.

Yet a further object of the present invention is to provide a new and improved fluid-cooled smoking device which is sturdy and rugged in construction.

A yet further object of the present invention is to provide a new and improved fluid-cooled smoking device which is uniquely well-suited for the purpose of smoking rate and expensive tobaccos.

A yet still further object of the invention is to provide a new and improved fluid-cooled smoking device which is readily portable and readily adaptable to efficient shipment in bulk.

A still yet further object of the present invention is to provide a new and improved fluid-cooled smoking device which may be rendered water-tight for shipment purposes.

BRIEF SUMMARY OF THE INVENTION

The foregoing and other objectives are achieved in accordance with the present invention through the provision of a fluid-cooled smoking device which includes a housing for containing a liquid coolant, and a tubular member projecting into the housing for supporting a smoking bowl-ash receptacle assembly disposed upon and within the tubular member. Concentric tubular members within the ash receptacle portion of the assembly define a serpentine flow path whereby the smoke and fumes to be inhaled are initially air-cooled, and subsequently, the air-cooled smoke and fumes pass into the liquid coolant so as to be liquid-cooled prior to reaching the smoker. The ash receptacle accumulates burnt tobaccos and ash deposits and prevents the same from entering the liquid coolant whereby the latter remains clean for extended period of time.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
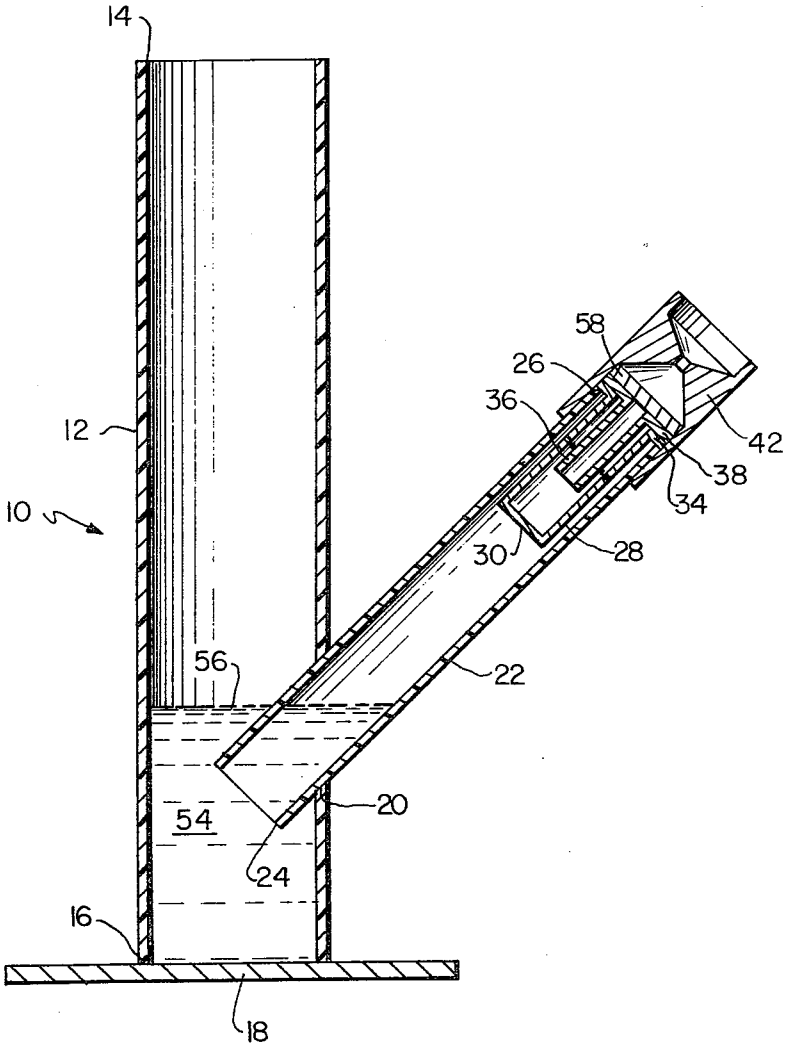
FIG. 1 is a cross-sectional view of the first embodiment of a fluid-cooled smoking device constructed in accordance with the present invention and showing its cooperative parts.

Referring now to the drawings, and more particularly to FIG. 1 thereof, there is shown one embodiment of a fluid-cooled smoking device constructed in accordance with the present invention and generally indicated by the reference character 10. The device includes a first, vertically disposed cylindrical tube or housing 12 which is open at its upper end 14 and closed at its lower end 16 by means of a planar base, support plate 18 fixedly secured thereto in a fluid-tight manner. An aperture or bore 20 is provided within a sidewall portion of tubular housing 12 and a second tubular member 22 is inserted through aperture 20, in a friction-fit manner, such that the lower, open end 24 of member 22 is disposed interiorly of tubular housing 12 while the upper, open end 26 of member 22 is disposed exteriorly of housing 12. It is of course noted that bore 20 has been defined within the sidewall portion of housing 12 in such a manner that when member 22 is disposed therein, such member has a predetermined inclination with respect to the vertical axis of tubular housing 12.

Figure 2:
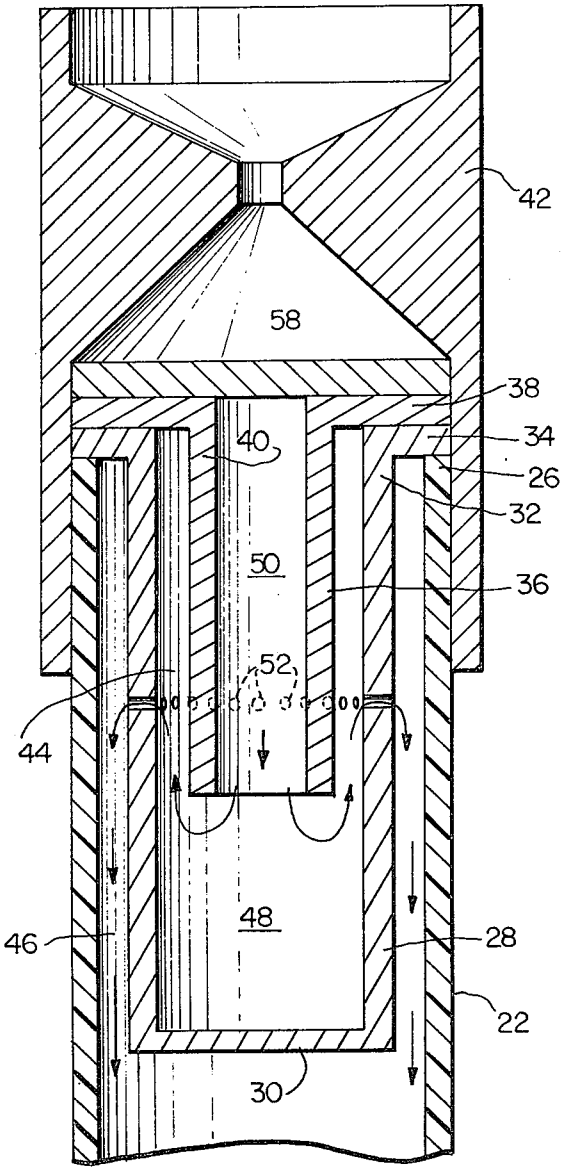
FIG. 2 is an enlarged, partial, cross-sectional view of the smoking bowl-ash receptacle assembly of FIG. 1.

With additional reference being made to FIG. 2, it is also apparent that in accordance with the present invention, a tubular receptacle 28 is adapted to be disposed within the upper end 26 of tubular member 22 and it is seen that receptacle 28 is closed at its lower end by means of an integral end wall 30 and is open at its upper end 32, an external peripheral flange 34 being integrally formed upon the upper end 32 whereby receptacle 28 is able to be dependently supported upon the upper end 26 of tubular member 22.

An additional tubular member 36, open at both ends thereof, is similarly provided with an external peripheral flange 38 integrally formed upon the upper end 40 thereof, and in this manner, member 36 may be likewise dependently supported within receptacle 28 and upon the upper end 32 thereof as a result of flanged portion 38 thereof resting upon flanged portion 34 of receptacle 28. It will be noted that the external diametrical extents of flanged portions 38 and 34 are equal to that of tubular member 22, and when a smoking bowl 42, which may be a non-reversible bowl or a reversible-type bowl as disclosed within applicant's U.S. Pat. Nos. 3,872,872 and 3,863,646, the structure, purposes and use of which is incorporated herein by reference, is disposed over the upper end 26 of tubular member 22, as well as flanged portions 34 and 38 of receptacle 28 and tubular member 36, respectively, the members 36, 28 and 22 are maintained in a concentric relationship.

It will be noted still further that as the external diameter of tubular member 36 is less than the internal diameter of receptacle 28, and similarly, as the external diameter of receptacle 28 is less than the internal diameter of tubular member 22, members 36 and 28 are respectively radially spaced from members 28 and 22 so as to define therebetween annular fluid passageways 44 and 46. In addition, as the depth of tubular member 36 is less than that of receptacle 28, a chamber 48 is similarly defined within the bottom portion of receptacle 28 so as to fluidically interconnect a central fluid passageway 50, defined within tubular member 36, with annular fluid passageway 44 and in order to fluidically interconnect fluid passageways 44 and 46, a plurality of holes or apertures 52 are formed within, and circumferentially disposed about the upper portion of receptacle 28.

In using the smoking device of the present invention, water or other liquid 54, for example, wine, is initially deposited within housing 12 such that the liquid level 56 is just above the lower end 24 of tubular member 22 so as to fully immerse the same, and upon depositing a desired amount of tobacco within smoking bowl 42, smoke may be drawn through the device 10 as a result of the inhalation of a smoker who has placed his mouth upon the smoke withdrawal means which is the upper open end 14 of housing 12. A filter member 58, as disclosed within applicant's co-pending application Ser. No. 601,286, filed Aug. 4, 1975, may be removably disposed within smoking bowl 42 so as to rest upon flanged portion 38 of tubular member 36, and in this manner, large-sized particles of burnt tobacco will be retained therein and thereby, however, other tobacco particles and/or ash entrained within the smoke passing through filter 58 and downwardly through fluid passageway 50 will tend to become deposited within the bottom portion of receptacle 28 and more particularly upon the interior surface of end wall 39, receptacle 28 thereby serving as an ash depository.

After traversing passageway 50 and chamber 48, the smoke passes upwardly through annular chamber or passageway 44, and upon exiting from apertures 52, continues downwardly through annular chamber or passageway 46 so as to enter tubular member 22. As the lower end 24 of member 22 is immersed within the liquid 54, the smoke enters liquid 54 and passed therethrough until the same reaches the water level 56. The smoke then exits from the liquid and passes upwardly through housing 12 so as to be inhaled by the smoker.

It will thus be apparent from the foregoing that through means of the particular disposition of members 36, 28 and 22, as well as the apertures 52, a serpentine fluid passageway has been defined within the smoking device 10. This serpentine passageway substantially elongates the path over which the smoke is caused to travel from the smoking bowl 42 to the open end 14 of tubular housing 12 and to the smoker, and in this manner, cooling of the smoke is effectively facilitated. More particularly, the smoke, during passage through passageways 50, 44 and 45 is, in effect, air-cooled, and subsequently, during passage through the lower end of tubular member 22 is water cooled. Still further, the structural arrangement of the members also serves to provide an ash depository within the upstream portion of the serpentine passageway, and in this manner, smoke reaching the liquid chamber is already cleansed whereby the liquid will remain clean and non-contaminated for longer periods of time which effectively obviates changing the same.

Figure 3:
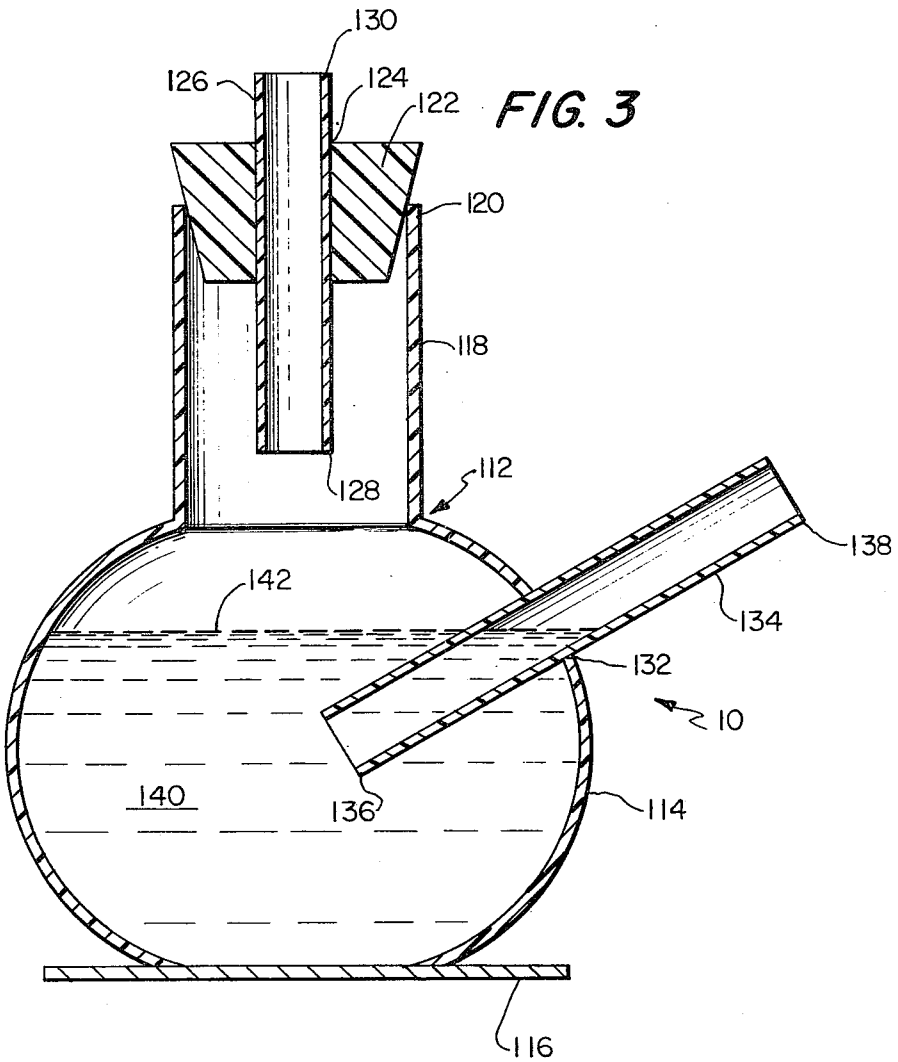
FIG. 3 is a view similar to that of FIG. 1, showing however another embodiment of the present invention.

Referring now to FIG. 3, another embodiment of the present invention is disclosed wherein the device 10 is seen to include a flask-type housing 112 which preferably comprises a substantially spherical bottom portion 114 having a planar base plate 116 integrally secured thereto sealing the same and supporting the device 10, and an upper tubular portion 118 having a diametrical extent substantially less than that of spherical portion 114. The upper end portion 120 of section 118 is open and a frusto-conical plug-type closure 122 is tightly seated therein. Plug 122 is provided with a central bore 124 and a first tubular member 126 open at both ends thereof is inserted therethrough in a fluid-tight manner such that the lower end 128 is disposed interiorly of housing 112 while the upper end 130 thereof is disposed exteriorly of housing 112 and plug 122.

An aperture 132 is provided within a sidewall portion of spherical section 114 and a second tubular member 134, open at both ends, is disposed therein and passes therethrough, in a frictionally, or alternatively, fitter manner, such that the lower end 136 is disposed interiorly of housing 112 while the upper end 138 projects exteriorly of housing 112. A suitable liquid 140 is disposed within housing 112 such that the level 142 thereof is above the lower end 136 of tubular member 134, and in this manner, immersion of the lower end 136 of member 134 is similar to that of end portion 24 of tubular member 22 of the embodiment described hereinabove.

It is quite apparent that with the structure of the embodiment of FIG. 3, either of the tubular members 126 and 134 may be deemed to be the equivalent of tubular member 22, and consequently, the smoking bowl-ash receptacle assembly may be disposed upon either one of the members 126 and 134 while the other member is used for inhaling the smoke from the tobacco. It is understood that when the smoking bowl-ash receptacle assembly is disposed upon member 126, the level 142 of the coolant should be below the lower end 136 of tubular member 134.

Figure 4:
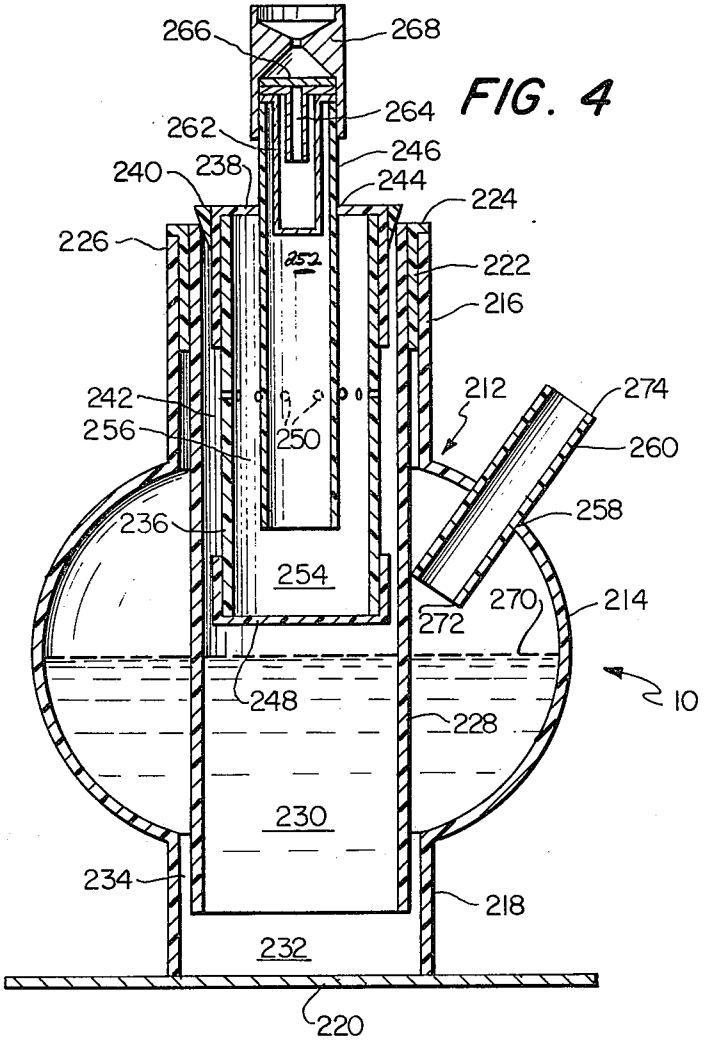
FIG. 4 is a view similar to that of FIG. 1 showing still yet another embodiment of the present invention.

Considering now the embodiment of the present invention illustrated within FIG. 4, the device 10 is seen to include a flask-type housing 212 which preferably comprises a substantially spherical central portion 214 and upper and lower tubular sections 216 and 128, respectively, of diametrical extents substantially less than that of spherical section 214. The bottom portion of tubular section 218 is integrally secured to a plate-type base 220, and the upper end of section 216 is open. An annular spacer 222 is frictionally secured within the upper portion of tubular section 216 and includes an external, peripheral flange 224 at its upper end for engaging the upper end 226 of section 216 whereby spacer 222 is properly seated therein. A tubular member 228, open at both ends thereof, is fixedly secured at the upper end thereof, to the inner peripheral surface of spacer 222 so as to depend therefrom, the lower end of member 228 being spaced above the base plate 220. As the diametrical extents of sections 216 and 218 are substantially equal, spacer member 222 serves to support the lower end of tube 228 in concentric fashion with respect to section 218 of housing 212, and in this manner, a continuous fluid passageway is defined within the device and is seen to include a central passageway 230 defined within tube 228, a chamber 232 defined between the lower end of tubular member 228 and base plate 220, and an annular passageway 234 defined between the outer peripheral surface of the lower end portion of tubular member 228 and the inner peripheral surface of housing section 218.

Another tubular member 236, open at both ends thereof, has a cup-shaped rubber cap 238 frictionally fitted over the upper end thereof so as to close the same, and a substantially annular, frusto-conical spacer 240 is similarly disposed externally about the upper end of cap 238. As a result of the conicity of spacer 240, as well as the relative axial position of the same with respect to that of tube 228 and the comparative external and internal diametrical extents of tubular member 236 and cap 238, and tubular member 228, respectively, when tube 236, cap 238 and spacer 240 are inserted within the upper end of tube 228, spacer 240 will tightly engage and be seated upon the inner peripheral surface of the uppermost end portion of tube 228 so as to radially space tube 236 from tube 228 and thereby define an annular fluid chamber 242 therebetween.

Cap 238 is provided with a central aperture 244 within and through which an additional tubular member 246, open at both ends, is disposed by means of a friction fitting, and it is also seen that tubular member 236 is provided with another cup-shaped rubber cap 248 at the lower end thereof. The central portion of tubular member 236 is further provided with a plurality of apertures 250 disposed circumferentially thereabout, and the lower end of tube 246 is disposed above the interior end face of cap 248. In this manner, a continuous fluid passageway is defined within the aforenoted structure and is seen to include a central passageway 252 defined within tube 246, a chamber 254 defined between the lower end of tube 246 and the interior end face of cap 248, an annular passageway 256 defined between tubes 246 and 236, apertures 250, and annular passageway 242. As the diametrical extent of cap 248 is likewise spaced from the interior peripheral surface of tube 228 as a result of the support of the tubular assembly by means of spacer 240, and consequently, annular passageway 242 is fluidic communication with central passageway 230.

The spherical portion 214 of housing 212 is provided with an aperture 258 within and through which a tube 260 is frictionally or alternatively fitted, and a smoking bowl-ash receptacle assembly, similar to that of FIG. 2, may be disposed upon the upper end of tubular member 246. More particularly, the assembly may include receptacle 262, inner tubular member 246, filter 266, and smoking bowl 268, and consequently, it will be appreciated that as a result of the disposition of these latter elements upon tubular member 246, the embodiment of FIG. 4 comprises a dual-serpentine flow path for the smoke and fumes.

More particularly, in using the device of the present embodiment, tobacco will be deposited within bowl 268, and water will be deposited within housing 212 so as to achieve a level indicated at 270 which is below the lower end 272 of tube 260. The smoker will then place his mouth about the upper end 274 of tube 260, and upon inhaling, smoke will be drawn from bowl 268 through filter 266 and downwardly into the central passageway defined within tubular member 264. Ash deposits will be accumulated upon the interior end face of receptacle 262, and subsequently, smoke will be drawn upwardly through the passageway defined between members 262 and 264 so as to exit from receptacle 262 through means of its apertures, not shown. The smoke then travels downwardly within passageway 252 and into chamber 254, and upwardly again through annular pasageway 256 so as to exit from tubular member 236 through means of apertures 250. The smoke continues to traverse passageway 242 and upon encountering liquid level 270, enters the liquid and passageway 230. The smoke passes through chamber 232 and ultimately enters passageway 234, and upon again encountering water level 270, leaves the water and lastly enters tube 260 so as to be inhaled by the smoker. It is also to be noted that chamber 254, and more particularly, cap 248 and the lower portion of tubular member 236 also serve as a second ash receptacle for accumulating any ash that was not accumulated within receptacle 262.

Figure 5:
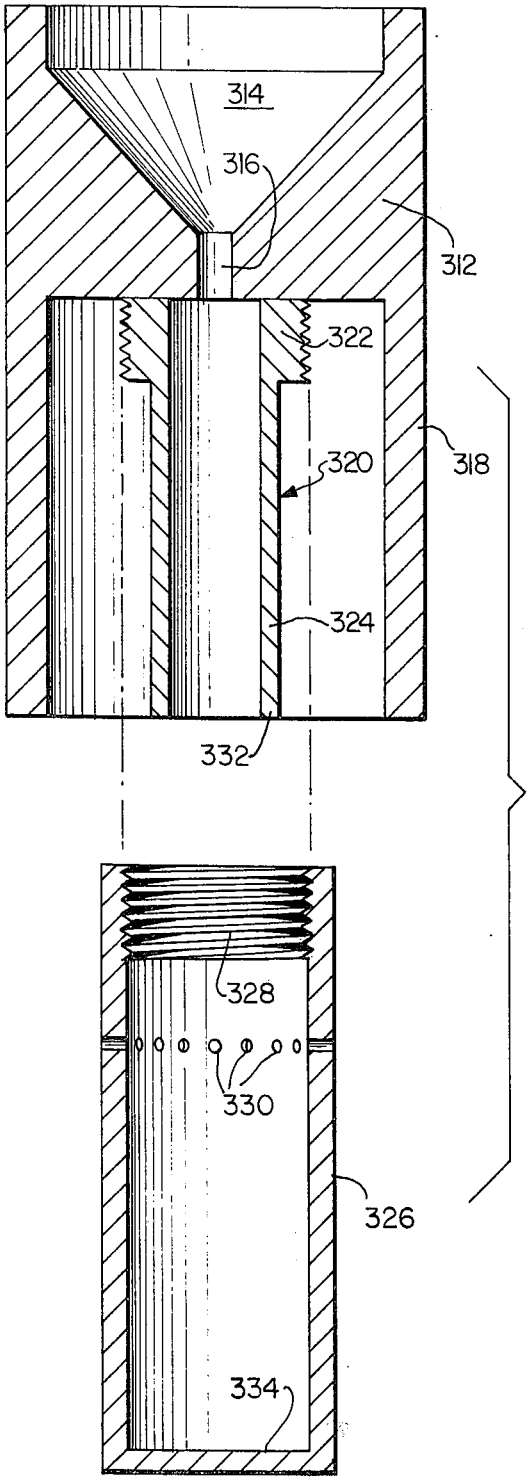
FIG. 5 is an exploded, cross-sectional view of a modified embodiment of the smoking bowl-ash assembly of the present invention.

Turning now to FIG. 5, while the smoking bowl-ash receptacle assemblies of the previous embodiments comprised individual separate members, the embodiment of FIG. 5 illustrates one form of a smoking bowl-ash receptacle assembly wherein, for example, the smoking bowl 312 may be provided with an upper tobacco compartment 314 and a central smoke passageway 316, however, in lieu of the lower mounting compartment, not numbered, as disclosed, for example, within FIG. 2, the smoking bowl 312 of the embodiment of FIG. 4 has an axially extending dependent, perimetrical skirt 318 and a central, dependent tubular member 320 integrally formed therewith, the latter member being similar to member 36 of the embodiment of FIG. 2. The upper portion 322 of member 320 is externally threaded and has a diametrical extent which is greater than that of lower portion 324, portion 322 being adapted to be threadedly mated with a separate receptacle member 236 similar to receptacle 28, which is internally threaded within the upper portion 328 thereof.

Receptacle 326 is also provided with a plurality of apertures 330 disposed circumferentially about the upper central portion thereof and below the threaded portion 328, and it will be appreciated that the depth of tubular member 320 is less than that of receptacle 326 such that a fluid chamber can be defined between the lower end portion 332 of member 320 and the interior end face 334 of receptacle 326. Similarly, the diametrical extents of tubular portions 322 and 324 are such as to define an annular fluid passageway between portion 324 and the interior perimetrical surface of receptacle 326, and still further, an annular passageway will likewise be defined between the outer peripheral surface of receptacle 326 and the inner peripheral surface of the tubular member, corresponding to member 22 of FIG. 2, after receptacle 326 is threadedly engaged with tubular member 320 and the assembled elements are disposed upon the tubular member corresponding to member 22 of FIG. 2 by means of the perimetrical skirt 318 of bowl 312 engaging the outer peripheral surface of such tubular member.

It is to be noted that in order to reduce machining materials and manufacturing costs, skirt 318 of bowl 312 can in fact be reduced in length or eliminated without any adverse effects upon the operation of the device, as will be described hereinafter in connection with the embodiment of FIGS. 7–9. Still further, in accordance with the embodiment of FIG. 6, in lieu of providing the threaded engagement between receptacle 326 and the upper portion of tubular member 320, such upper portion 322' can be non-threaded, as is the upper portion 328' of receptacle 326, however, the diametrical extents thereof are such as to produce a friction fitting therebetween. When skirt 318 is eliminated, the upper portion of receptacle 326 will have a flange for a tight fit of the same with the tube in which it is disposed (not illustrated).

Figure 6:
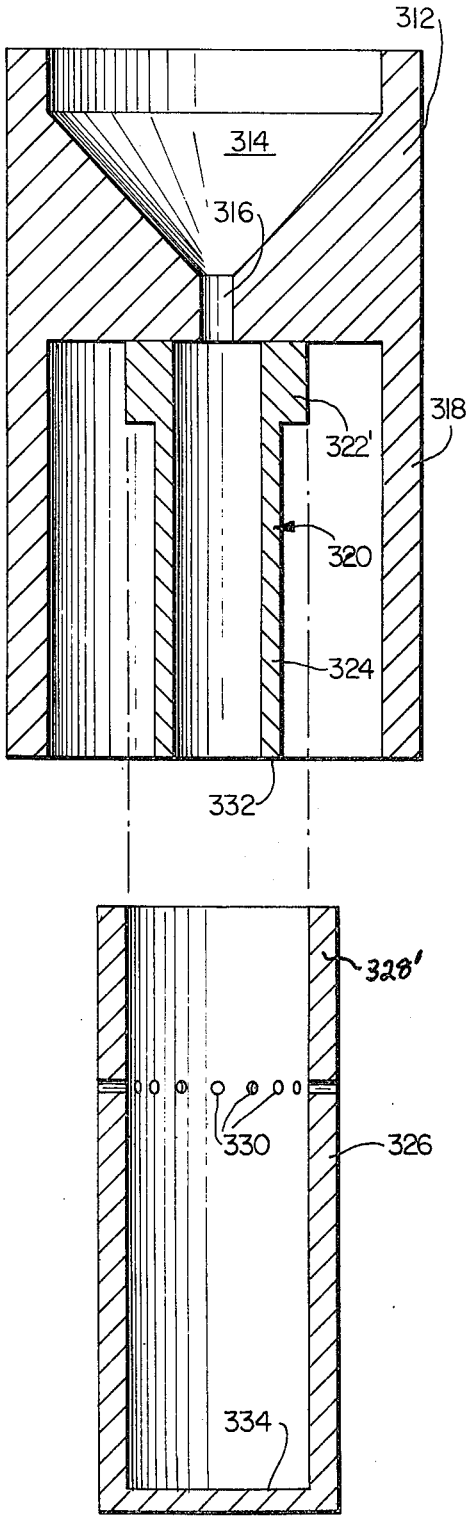
FIG. 6 is a view similar to that of FIG. 5, showing however another embodiment of the smoking bowl-ash receptacle assembly of the present invention.

It is of course also possible that in lieu of the flanged support system of the tubular members as disclosed within FIGS. 1 and 2, or the integral formation of the tubular member 320 with bowl 312 as in FIGS. 5 and 6, the tubular member 320 can be separate from the bowl 312 yet threadedly or frictionally engaged with receptacle 326.

It is also to be noted that in lieu of the receptacle members being fabricated of a solid material, the same could also be fabricated of a wire mesh material in which case the need for the apertures, for example, apertures 52, would be obviated.

Figure 7:
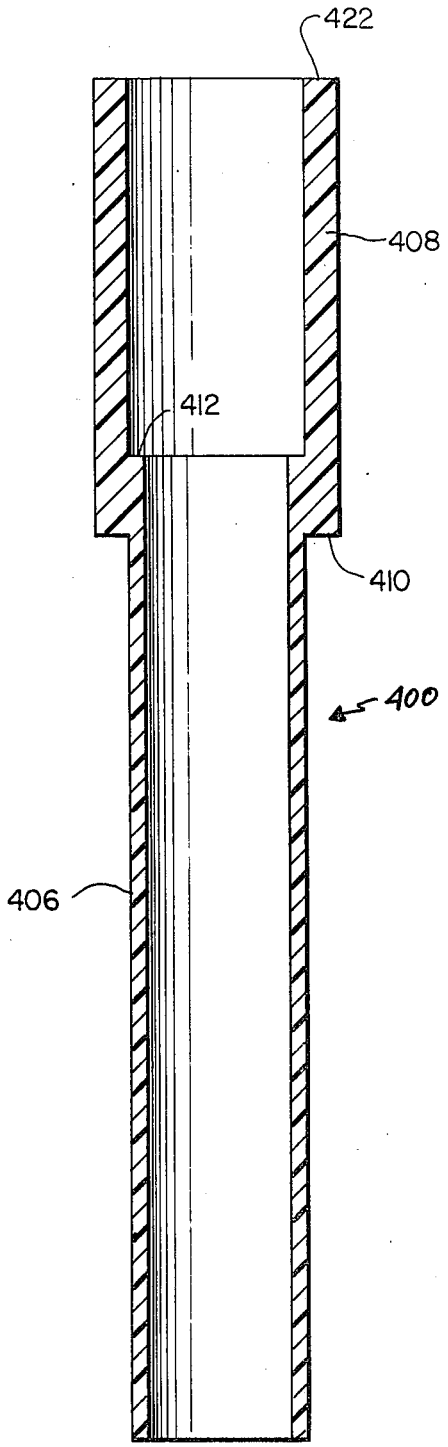
FIG. 7 is a cross-sectional view of a particularly configured tubular member adapted to be inserted within the tubular member laterally projecting from the main housing of the apparatus.
Figure 8:
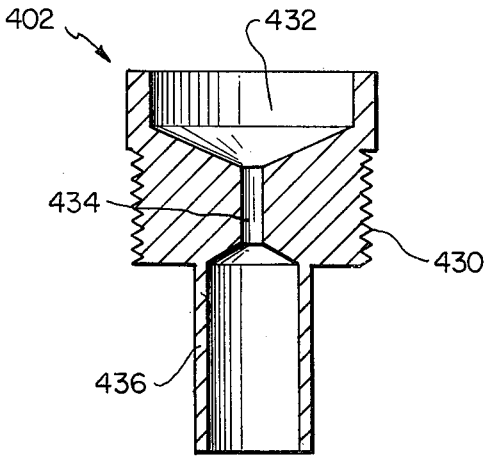
FIG. 8 is a cross-sectional view of a modified smoking-bowl which may be utilized within the apparatus of the present invention, particularly within the tubular member of FIG. 7.
Figure 9:
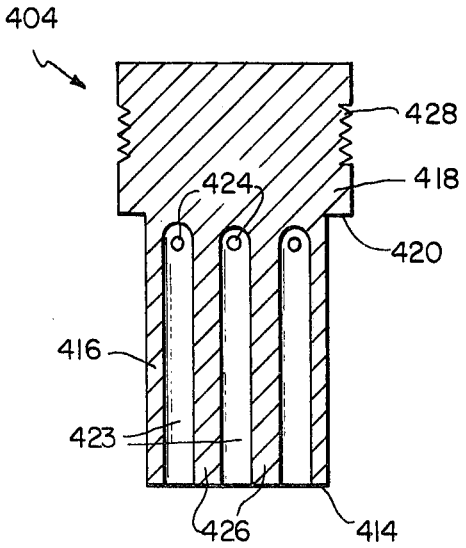
FIG. 9 is a cross-sectional view of a modified ash-receptacle which is adapted to be utilized in connection with the smoking bowl of FIG. 8 and the tubular member of FIG. 7.

Referring now to FIGS. 7–9, modified embodiments of an auxiliary tubular member, a smoking bowl, and an ash receptacle are respectively designated as 400, 402 and 404, the smoking bowl and ash receptacle being somewhat similar to the bowl 312 and receptacle 326, while tubular member is similar to, but adapted to be inserted within the upper, projecting end of, tubular member 22.

Tubular member 300, open at both ends thereof, is seen to comprise a lower tubular section 406, which has an external diameter which is slightly less than the internal diameter of tubular member 22 so as to permit insertion of the former within the latter, and an upper tubular section 408 which has an external diameter, which is substantially greater than that of the lower section 406 and equal to or slightly greater than that of tubular member 22, and an internal diameter which is substantially equal to the external diameter of lower section 406. In this manner, an external annular flange or shoulder portion 410 is defined by means of tubular sections 406 and 408 whereby the tubular member 400 may be dependently supported within the outer end portion of tubular member 22, shoulder portion 410 resting upon the annular edge surface of open end 26 of tubular member 22.

In a similar manner, an internal, annular shoulder portion 412 is defined within section 408 is a counterbored fashion, and in this manner, ash receptacle member 404 may be supported thereon, the lower peripheral portion 414 of member 404 being seated upon shoulder 412. With particular reference of FIG. 9, it is seen that receptacle 404 has a configuration somewhat similar to that of tubular member 400 in that the same includes a lower tubular section 416, closed at the lower end thereof, and an upper tubular section 418, open at the upper end thereof and having an external diameter which is substantially greater than that of lower section 146 so as to define therebetween and therewith an annular flange or shoulder portion 420.

The external diameter of section 416 is of course slightly less than the internal diameter of section 408 of tubular member 400 so as to permit the insertion of section 416 therewithin, and the external diameter of section 418 of receptacle 404 is seen to be substantially equal to or slightly greater than that of section 408 of member 400 so as to permit shoulder portion 420 to be seated upon the upper, peripheral edge 422 of section 408, it being additionally appreciated that the length or depth of lower section 416 is substantially the same as that of the portion of section 408 of member 400 which is defined between the upper edge surface 422 and shoulder portion 412 so as to permit the shoulder portion 420 and the lower peripheral surface 414 of receptacle 404 to be properly seated upon such portions of tubular member 400, respectively.

Lower section 416 of receptacle 404 is also provided with a plurality of axially extending recessed portions or grooves 423 which are disposed about the entire periphery of section 416, and a plurality of apertures 424 are respectively provided within the upper sections of grooves 423, the height of grooves 423 being such as to terminate below shoulder portion 420 so as to in turn dispose apertures 424 at an axial position therebelow. Member 404 may be made of thin sheet metal, and grooves 423 may simply be pressed thereinto in a corrugated manner, such that the outer surfaces thereof define a circular locus which has a diametrical extent somewhat less than that of the internal diameter of lower section 406 of member 400, and particularly that of shoulder portion 412, and in this manner, fluid passageways are able to be defined from the interior portion of receptacle section 416, through apertures 424, within grooves 423, and into section 406 of tubular member 400, receptacle 404 of course being supported upon member 400 by means of raised portions 426 of section 416, as well as by shoulder portion 420.

The upper section 418 of member 404 is internally threaded at 428 so as to threadedly mate with an externally threaded portion 430 of bowl 402 and it is seen that bowl 402 is substantially the same as, for example, bowl 312 of FIG. 5, in that the same includes a tobacco chamber 432, an axial passageway 434, and a lower tubular section 436, the major difference between the bowl of this embodiment and the bowl of the embodiment of FIG. 5 residing in the fact that the perimetrical skirt 318 has been eliminated.

Obviously, many modifications and variations of the present invention are possible in light of the above teachings. It is to be understood therefore, that within the scope of the appended claims, the present invention may be practiced otherwise than as specifically described herein.

What is claimed is:

1. A fluid-cooled smoking device comprising:
housing means for containing a volume of fluid;
means for containing a supply of tobacco to be smoked;
means operatively connected to said tobacco container means for introducing smoke into said housing;
means operatively connected to said housing for withdrawing said smoke from said housing; and
means disposed within said smoke introduction means for defining a first elongated serpentine flow path for said smoke upstream of said fluid,
whereby said smoke is cooled due to the travel of the same through said elongated path and said fluid.

2. A fluid-cooled smoking device as set forth in claim 1, wherein said housing means is of the flask type.

3. A fluid-cooled smoking device as set forth in claim 1, wherein said housing means is a cylindrical tube.

4. A fluid-cooled smoking device as set forth in claim 1, wherein said tobacco container means is a smoking bowl.

5. A fluid-cooled smoking device as set forth in claim 4, wherein said smoking bowl is a reversible smoking bowl.

6. A fluid-cooled smoking device as set forth in claim 1, wherein said smoke introducing means and said smoke withdrawal means comprise tubular members.

7. A fluid-cooled smoking device as set forth in claim 1, wherein said means defining said serpentine flow path comprises a plurality of concentrically disposed tubular members.

8. A fluid-cooled smoking device as set forth in claim 1, wherein said serpentine flow path means comprises:
a first tubular member operatively connected at one end thereof to said tobacco container means and defining a first fluid passageway therein, the other end thereof being open;
a second tubular member, closed at both ends concentrically disposed about said first tubular member;
means defining a second, annular passageway between said first and second tubular members, the lower end of said second member being disposed below the lower end of the said first tubular member so as to define an interconnecting chamber or passageway between said first and second passageways;
said smoke introducing means being concentrically disposed about said second tubular member so as to define therewith a third annular passageway; and
means defining a first set of apertures within said second tubular member for fluidically interconnecting said second and third annular passageways.

9. A fluid cooled smoking device as set forth in claim 8, wherein said first and second tubular members include flanged support means for supporting said tubular members within said smoke introducing means.

10. A fluid-cooled smoking device as set forth in claim 9, wherein said flanged support means are interposed between said smoke introducing means and said tobacco container.

11. A fluid-cooled smoking device as set forth in claim 8, further comprising ash receptacle means defined within said second tubular member for accumulating ash deposits.

12. A fluid-cooled smoking device as set forth in claim 8, whereby said first tubular member is separable from said tobacco container.

13. A fluid-cooled smoking device as set forth in claim 8, wherein said first tubular member is separable from said tobacco container.

14. A fluid-cooled smoking device as set forth in claim 13, further comprising:
said first tubular member includes first thread means; and
said second tubular member includes second thread means for threadedly engaging said first thread means of said first tubular member.

15. A fluid-cooled smoking device as set forth in claim 14, wherein:
said smoke introducing means includes a tubular member open at both ends and projecting through a sidewall portion of said housing, and an auxiliary tubular member open at both ends and dependently supported within the outer open end of said tubular member; and
said second tubular member is disposed and supported within a counterbored portion of said auxiliary tubular member.

16. A fluid-cooled smoking device as set forth in claim 15, wherein said auxiliary tubular member is provided with an internal shoulder means for supporting said second tubular member.

17. A fluid-cooled smoking device as set forth in claim 15, wherein said auxiliary tubular member and said second tubular member are respectively provided with external shoulder means for supporting themselves, in a dependent manner, upon the outer ends of said tubular member and said auxiliary tubular member, respectively.

18. A fluid-cooled smoking device as set forth in claim 15, wherein:

said second tubular member has a plurality of axially extending grooves defined within the peripheral surface thereof for defining said third annular passageway between said second tubular member and said auxiliary tubular member; and said apertures are defined within the upper portions of said grooves.

19. A fluid-cooled smoking device as set forth in claim 18 wherein:

said second tubular member is made of sheet metal; and said grooves are defined within said second tubular member in a corrugated fashion.

20. A fluid-cooled smoking device as set forth in claim 13, further comprising:

said first tubular member includes a first enlarged diametrical portion; and said second tubular member includes means for engaging said enlarged diametrical portion by a friction fitting.

21. A fluid-cooled smoking device as set forth in claim 8, wherein said means defining said second, annular passageway comprises flanged means upon said first and second tubular members of different diametrical extents.

22. A fluid-cooled smoking device as set forth in claim 8, wherein said means defining said second, annular passageway comprises enlarged diametrical means formed upon said first tubular member and operatively engaged with said second tubular member for radially spacing the same therefrom.

23. A fluid-cooled smoking device as set forth in claim 1, further comprising additional means for defining a second elongated serpentine flow path for said smoke, said additional means being interposed between said first serpentine flow-path defining means and said smoke withdrawal means, and partially disposed within said fluid.

24. A fluid cooled smoking device as set forth in claim 23, wherein said additional means comprises:

a third tubular member operatively connected to said smoke introducing means at one end thereof for defining a fourth fluid passageway within said third tubular member, the other end thereof being open;

a fourth tubular member, closed at both ends, concentrically disposed about said third tubular member;

a fifth annular fluid passageway defined between said third and fourth tubular members, the lower end of said third member being disposed above the lower end of said fourth member so as to define an interconnecting chamber or passageway between said third and fourth passageways;

a fifth tubular member, closed at one end and concentrically disposed about said fourth tubular member so as to define therewith a sixth annular fluid passageway and open at the other end and defining a seventh fluid passageway therewithin, the lower end of said fifth tubular member being disposed above the base of said housing, so as to define a chamber or passageway interconnecting said seventh passageway with an eighth annular passageway defined between the lower end of said fifth tubular member and said housing.

25. A fluid-cooled smoking device as set forth in claim 24 further comprising second ash receptacle means removably secured to the lower end of said fourth tubular member.

26. A fluid-cooled smoking device as set forth in claim 25, wherein said second ash receptacle means is a cup-shaped cap.

27. A fluid-cooled smoking device as set forth in claim 23, further comprising spacer means for retaining said fifth tubular member disposed concentrically about said fourth tubular member and for defining said sixth annular fluid passageway.

28. A fluid-cooled smoking device as set forth in claim 1, further comprising ash receptacle means disposed within said serpentine flow path for accumulating ash deposits.

29. A fluid-cooled smoking device as set forth in claim 28, wherein said ash receptacle means is disposed upstream of said fluid.

30. A fluid-cooled smoking device, as set forth in claim 1, further comprising filter means interposed between said tobacco container means and said smoke introduction means.

* * * * *